United States Patent [19]

Trimble

[11] 4,328,745

[45] May 11, 1982

[54] QUICK ACTING AUTOMATIC MARKING MACHINE

[75] Inventor: Roy L. Trimble, Theodosia, Mo.

[73] Assignee: Signode Corporation, Glenview, Ill.

[21] Appl. No.: 152,661

[22] Filed: May 23, 1980

[51] Int. Cl.[3] ..... B41F 17/08

[52] U.S. Cl. ..... 101/7; 101/39; 101/40

[58] Field of Search ..... 101/7, 38 R, 38 A, 39, 101/40

[56] References Cited

U.S. PATENT DOCUMENTS

| | | | |
|---|---|---|---|
| 2,316,517 | 4/1943 | Huntley et al. | 101/7 |
| 2,768,575 | 10/1956 | Leonard | 101/39 |
| 2,974,584 | 3/1961 | Cope et al. | 101/39 |
| 3,030,881 | 4/1962 | Friedman | 101/7 |
| 3,309,986 | 3/1967 | Worth | 101/39 |
| 3,822,639 | 7/1974 | Szpitalak | 101/40 |
| 3,956,983 | 5/1976 | Dittrich et al. | 101/7 X |
| 4,051,775 | 10/1977 | Watson | 101/38 A |
| 4,129,206 | 12/1978 | Talbott | 101/40 X |
| 4,258,621 | 3/1981 | Bickett | 101/7 X |

*Primary Examiner*—Edward M. Coven

*Attorney, Agent, or Firm*—Dressler, Goldsmith, Shore, Sutker & Milnamow, Ltd.

[57] ABSTRACT

A novel, high-speed, efficient, versatile, automatic machine is provided for the marking of parts. A wheeled platform is driven in a reciprocating cycle by a slotted arm and a revolving roller. The platform carries a rotatably mounted mandrel to couple the part to be marked to the reciprocating platform. The platform forces the part across a stationary marking die. Accessories are provided to automatically feed parts onto the platform and to automatically eject marked parts from the platform. Provisions are made to hold the platform stationary while a part is coupled to the mandrel and to guide and stabilize the unmarked part until it is coupled to the mandrel. Components and accessories are positioned for easy access for alignment and set-up.

13 Claims, 8 Drawing Figures

14
16
42
20
22
18
140
21
24
12
26
11
10

10
82
83
81
20
18
72
70
71
6.
37
36
84
53
28
50
47
52
29
49
60
46
116
153
48
39
163B
27
44
163A
162
155
154
132
104
128
130
17
100
181
21
15
38
102
114A
114B
110A
110B
112
108
19
12
6.

10
23
25
20
40
65
145
27
122
36
143
140
146
49
106
116
46
32
142
39
139
125
47
155
48
141
126
124
120A
120B
118
163A
163'
163''
163'''
60
152
154
181L
182
104
144
132
181H
181
183
180
130
38
128
100
102
108
111
170
110B
12

25
47
29
28
27
53
49
36
32
40
65
150A
150B
8
8
161
156
152
159
153
162
163A
164
163'
163''
155
39
48
116
116'
122
106
120A
120B
102
104
128
130
132
157A
157B
154
151A
151B
153
159
163A
163B
32

QUICK ACTING AUTOMATIC MARKING MACHINE

TECHNICAL FIELD

This invention generally relates to marking machines or those machines used to imprint identifying characters on small parts and other objects. In particular, the invention concerns a novel highspeed, automatic, marking machine incorporating features facilitating easy adjustment, alignment and set-up.

BACKGROUND OF THE INVENTION

Today, with the increased emphasis on products liability and reliability, there is a greater need than ever before to identify machine parts and other components. Typically, a part is marked to indicate its origin, to aid in identifying a replacement, or to indicate its position or location within a major component or sub-assembly. The basic method for marking parts, and in particular hollow objects such as nuts, spark plugs, collars, bushings and the like, involves the use of a stud arbor. In that method, the part that is to be marked is manually positioned on a stud arbor. When the stud arbor is activated, the part is forced to come into contact with a marking die. The die, being of harder material than the object to be marked, impresses one or more characters on the exterior surface of the part. The part is then manually removed from the stud arbor. Other objects to be identified are similarly manually located, marked and removed.

One manual machine that has received wide acceptance in the industry is one manufactured by the George T. Schmidt Company. These manual machines are ordinarily provided with accessories for roll marking large cylindrical parts, springs return mechanisms to return the marking die to the same location after each marking cycle, and keys or jigs to insure that the object to be marked is marked at the same location on the part each time. It should be appreciated that any machine or mechanism relying upon manual steps or the intervention of a human operative is inherently slow. On the other hand, such machines are especially useful in those industrial processes where only a relatively few parts must be marked or where the individual parts require special attention or alignment on a stud arbor. For example, the bezel on a camera lens is a part commonly marked with a manually operated stud arbor.

In order to speed production, a marking machine having an automatic reciprocating arbor was soon developed. Ordinarily, these machines are hydraulically operated and are synchronized with a chute containing a number of similar parts to be marked. In one device, a hydraulic cylinder operated a ratchet mechanism to actuate a revolving spider. The spider would carry the part under the marking die and hold it in such a manner that the object was free to rotate as the marking die was driven across its exterior surface. In some machines, the rotation of the stud arbor was synchronized with the marking die by a rack and pinion drive. Some machines employ a Geneva gear to rotate the spider, to eject the marked part and to receive an unmarked part from the supply chute. Typical speeds are from 2,000 to 3,000 parts marked per hour.

To further speed production, continuously moving, planetary machines were developed. In these machines, the stud arbor has time to become fully inserted within the hollow object while the machine is operating without the marking cycle being interrupted. In one planetary machine, each compartment of the planetary feed mechanism has its own reciprocating arbor. A concave lettering die is used to imprint characters on the parts. Hollow, round parts needing internal support, however, have to be manually placed on a support stud prior to marking. Speeds in excess of 3,000 pieces marked per hour have been achieved. The George T. Schmidt Co. Model 135 marking machine is a typical example. As can be appreciated, planetary marking machines are somewhat complex and, by necessity, require more than one arbor in order for such high rates of marking to be achieved. Planetary machines are limited in their versatility in that the separate compartments are unique or specifically related to the size of the object to be marked. Thus, interchangeability between different parts requiring marking is complicated and relatively expensive. In addition, such machines operate at one speed, the same speed being used to move the parts through the machine before, during, and after marking. Relatively speaking, a large portion of the marking time or cycle is devoted to moving the object relative to the time actually spent marking the object. In this sense, planetary machines are inefficient. A fast, efficient, versatile, simple-to-operate, and easy-to-maintain marking machine would be a welcome addition to the marketplace and would satisfy a long-felt, but heretofore unsatisified need by the industry for improved marking machines.

SUMMARY OF THE INVENTION

In accordance with the present invention, an efficient high-speed machine is provided for marking parts. The machine features two-speed operation and a single marking die. In addition, accessories are provided to automatically insert parts into the machine for marking and to automatically remove marked parts. Specifically, a quick-return linkage drives a table reciprocally in a cycle between a start position and a finish position. The table carries a mandrel that is free to move between raised and lowered positions. The mandrel is specially designed to fit within an opening in the part to be marked. Once the part has been placed on the table and coupled to the mandrel, the table is stroked and the part is forced against the marking die. The marking die contains a number of characters or raised letters arranged in a line. As the part is drawn across these letters, the relatively soft surface of the part is imprinted with the characters on the die. Since the mandrel is free to rotate about an axis perpendicular to the plane of the table, the part is marked serially—one letter at a time. After marking, the mandrel is withdrawn from the part, thereby freeing the part to be ejected from the table. The quick-return linkage then returns the table to the start position at a relatively high speed compared to the speed of the table from the start to the finish position. Considered on a cycle-time basis, the efficiency of the marking phase is considerably improved over that found in planetary and intermittent-feed marking machines. In addition, the quick-return linkage used in the machine provides a certain amount of dwell at two points (the start and the finish position) on the cycle, thus allowing the table to remain relatively stationary while parts are coupled to the table and while parts are ejected from the table. The use of only one arbor or mandrel rather than one arbor for every compartment (as in the case of planetary marking machines) makes the invention less complicated and easier to set-up than previous machines. These advantages result in appreciable cost savings to the manufacturer and the purchaser.

Numerous other advantages and features of the present invention will become readily apparent from the following detailed description of the invention and the embodiment illustrated therein, from the claims and from the accompanying drawings in which each and every detail shown is fully and completely disclosed as part of this specification and in which like numerals refer to like components.

DETAILED DESCRIPTION OF THE PREFERRED EMBODIMENT

While the invention will be described in connection with the preferred embodiment, it will be understood that it is not intended to limit the invention to that particular embodiment or the method associated with its use. On the contrary, it is intended to cover all alternatives, modifications, and equivalents as may be included within the spirit and scope of the invention as defined by the appended claims.

Figure 1:
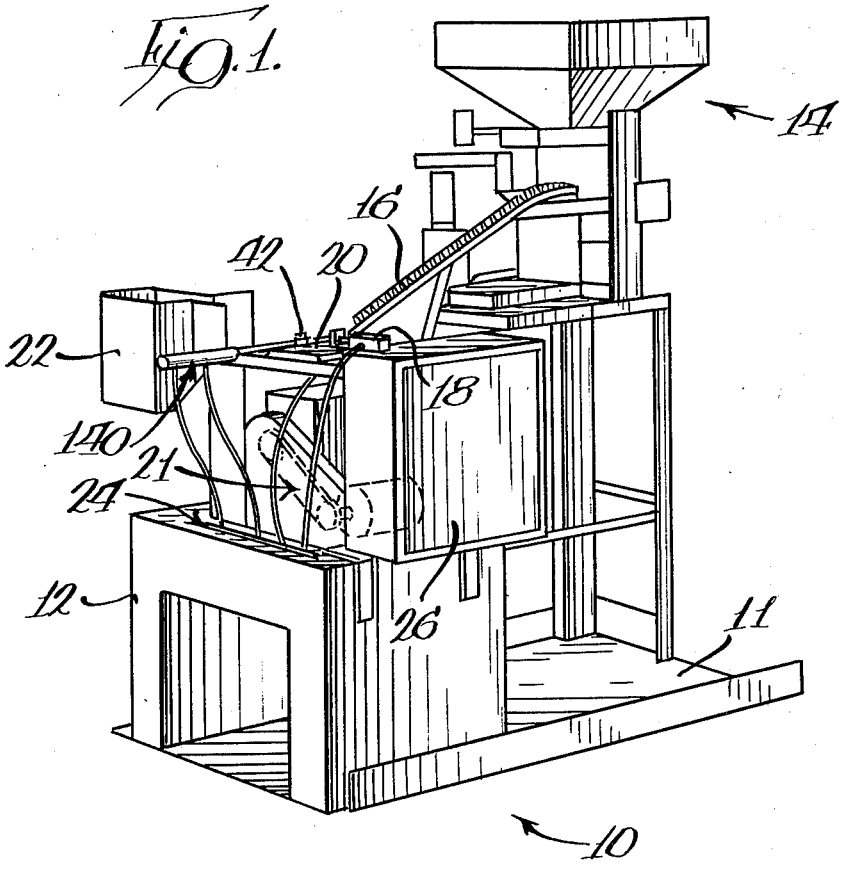
FIG. 1 is a perspective view of the prototype machine that is the subject of the present invention; also included, is the mechanism used to feed parts onto the machine for marking.

Turning to the drawings, FIG. 1 is a perspective view of an apparatus embodying the principles of the invention. Specifically, the marking machine 10 is supported on a foundation 12 adjacent a parts feeder 14. The parts feeder 14 supplies unmarked parts serially down a supply chute 16 to a feeding mechanism 18 which inserts the parts, one at a time, on the upper surface of marking table 20 of the machine 10. As each part is marked, the marked part is discharged by an ejection mechanism 42 into a collection bin 22 located at one end of the marking table 20. Also illustrated, are a number of pneumatic hoses and fittings 24 used to operate accessories and subsystems associated with the marking machine 10. These accessories will be explained in detail at a later point in this discussion. A metal shielded enclosure 26, immediately adjacent to the marking machine 10, provides a convenient location for housing electrical and pneumatic accessories and controls. An electric motor and reduction gear assembly 21 drives the marking table 20.

Figure 2:
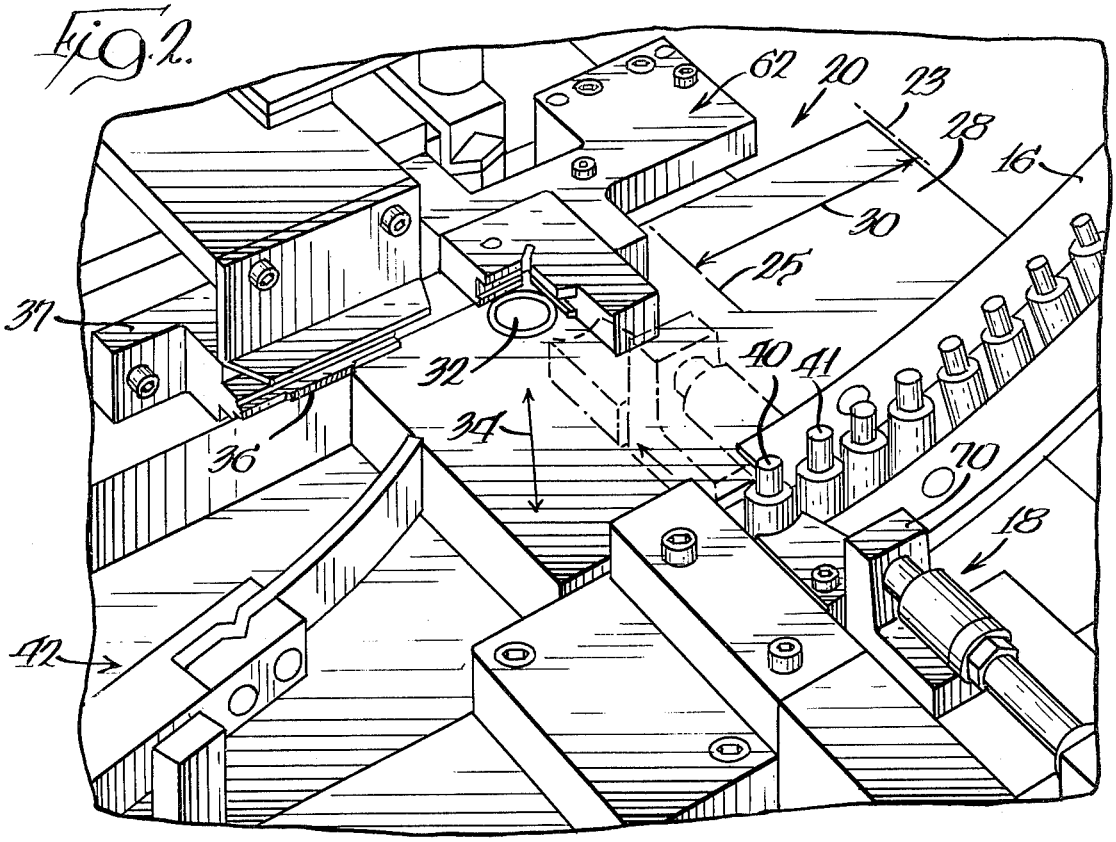
FIG. 2 is a perspective view of the upper surface or marking table illustrating the manner in which parts are brought onto the table for marking and the principle features of the table.

In order to place the various components of the machine 10 in their proper perspective, the overall operation of the machine 10 will be briefly described and then the major components and elements will be described in detail. Referring to FIG. 2, there is illustrated a perspective view of the marking table 20. The marking table supports the principal components of the invention that are related to the marking of the parts. Specifically, the marking table 20 includes a carriage 28 (alternatively referred to as the "moving portion of the marking table") that is free to move reciprocally in a straight line (arrow 30) between start 23 and finish 25 positions (represented by dashed lines). The carriage 28 carries a mandrel 32 that is free to move vertically (arrow 34) between a raised and a lowered position. The mandrel is also free to rotate about a vertical axis perpendicular to the plane of the carriage 28. Adjoining the carriage 28 and the mandrel 32, is a marking die 36. The marking die 36 remains stationary while the carriage 28 moves between the start 23 and finish 25 positions. Parts supplied by the supply chute 16 arrive serially adjacent the feeding mechanism 18. When the carriage 28 is in the start position 23 (i.e., the position shown in FIG. 2), and the mandrel 32 is lowered, the machine 10 is ready to receive a part for marking.

At that time, the feeding mechanism 18 drives a part 40 onto the carriage 28 in such a position that the mandrel 32, can engage and couple the part 40 to the marking table 20. A parts locator 62 guides the part 40 into position. Once the part 40 has been coupled to the mandrel 32 and the feeding mechanism 18 has been withdrawn from the marking table 20, the carriage 28 is free to be driven to the finish position 25.

Figure 3:
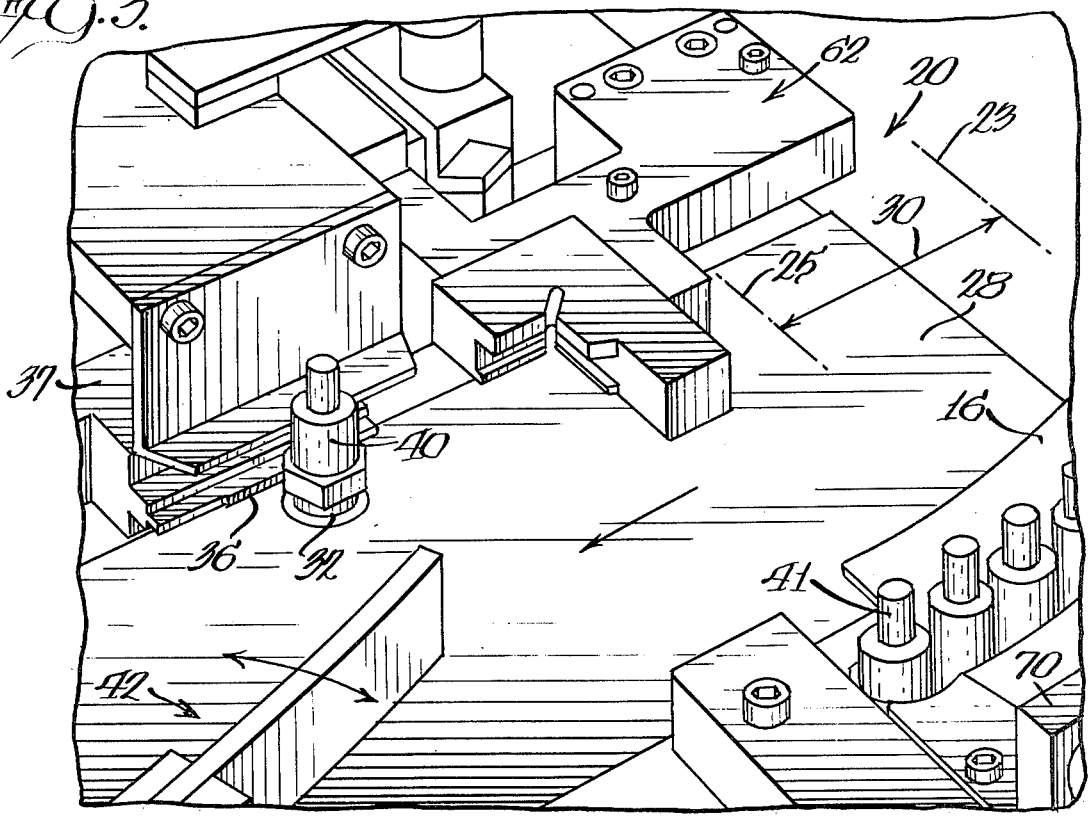
FIG. 3 illustrates an enlarged, perspective view of the same marking table shown in FIG. 2 illustrating a part being drawn across the marking die.

Referring to FIG. 3, after the part 40 has been coupled to the mandrel 32, the part 40 is driven across the marking die 36. Since the mandrel 32 is free to revolve about a vertical axis, the part 40, when coupled to the mandrel 32, is likewise free to rotate about a vertical axis. The mandrel 32 rotatably compresses an exterior surface of the part 40 against the marking die 36 which forces the letters or characters on the marking die 36 to be transferred onto the periphery of the part 40. After the part 40 has been marked and the carriage 28 has been moved to the finish position 25, the mandrel 32 is lowered to decouple the part 40 from the marking table 20. An ejection mechanism 42 is then actuated to sweep the marked part 40 from the marking table 20 into the collection bin 22 (see FIG. 1). Once the marked part 40 is removed from the marking table 20, the carriage 28 is ready to be re-positioned from the finish 25 to the start 23 position where the carriage will again be in position to accept a new part 41 for marking. Thus, the marking cycle consists of: (1) coupling a part 40 to a mandrel 32 carried by the carriage 28 that is free to move reciprocally along a straight line 30 from a start 23 to a finish position 25; (2) forcing the part 40 across the marking die 36 to imprint a set of characters on the exterior surface of the part; (3) decoupling the marked part from the carriage 28, and clearing the marked part from the marking table 20; and (4) returning the carriage from the finish position 25 to the start position 23. The details of the machine 10 will now be described.

MARKING TABLE

Figure 6:
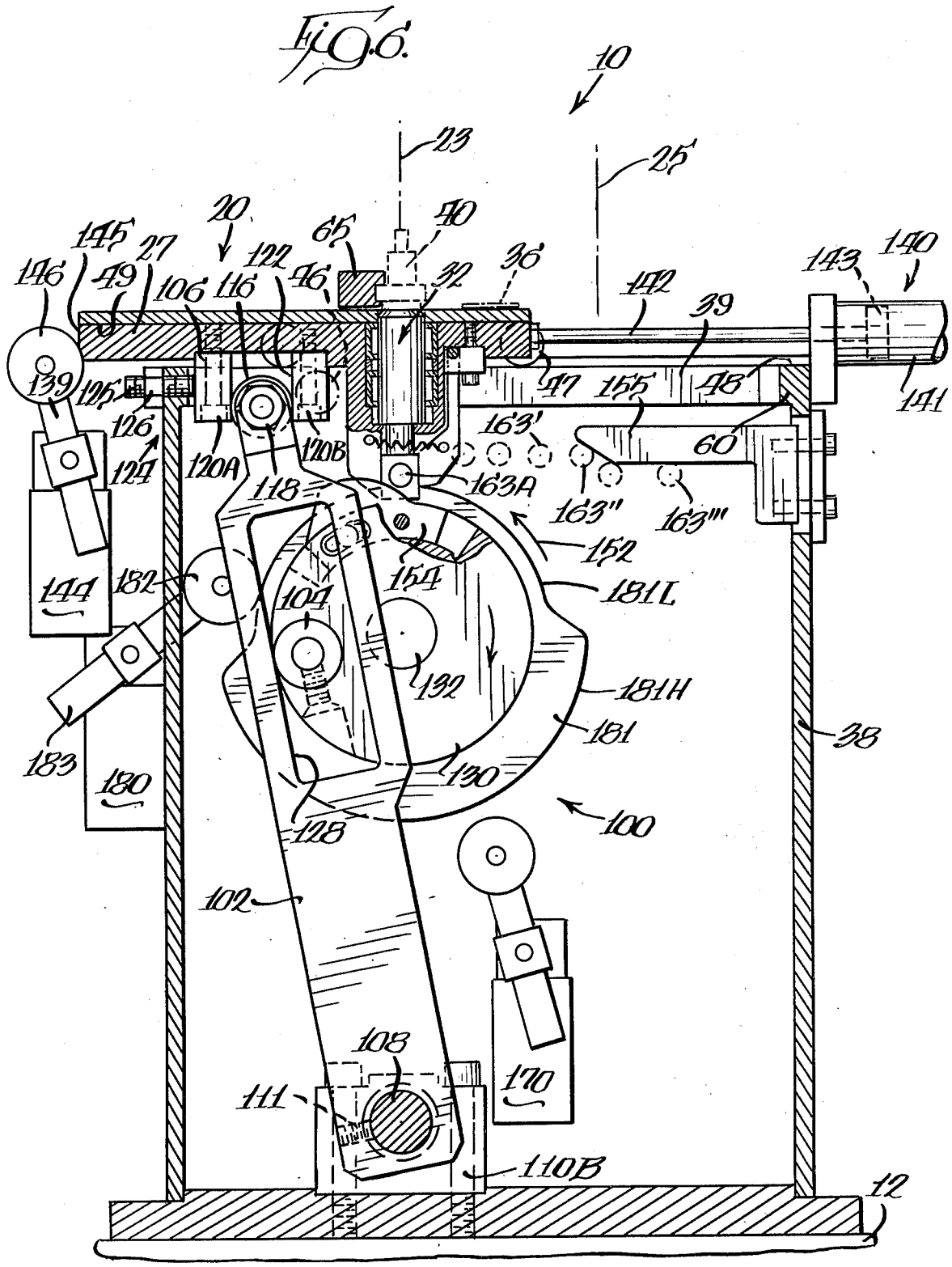
FIG. 6 is a cross-sectional side view of the marking machine shown in FIG. 5 as viewed along 6—6 illustrating the driving mechanism used to move the marking table.

The marking table 20 is formed from two major components or sub-assemblies: a fixed or stationary portion 39 and a moving portion or carriage 28. Referring to FIG. 6, the marking table 20 lies in a generally horizontal plane at the upper end of a box-shaped base 38. The base 38 can be made to any convenient height. As illustrated in FIG. 1, the base 38 itself is supported off the floor 11 by a foundation 12. A shorter, more compact machine 10 is better suited and more easily adaptable to be used in different locations. The fixed portion 39 of the marking table 20 is essentially an extension of the base 38. The carriage or moving portion 28 of the marking table 20 is formed from two major components, an upper carriage 29 and a lower carriage 27.

Figure 5:
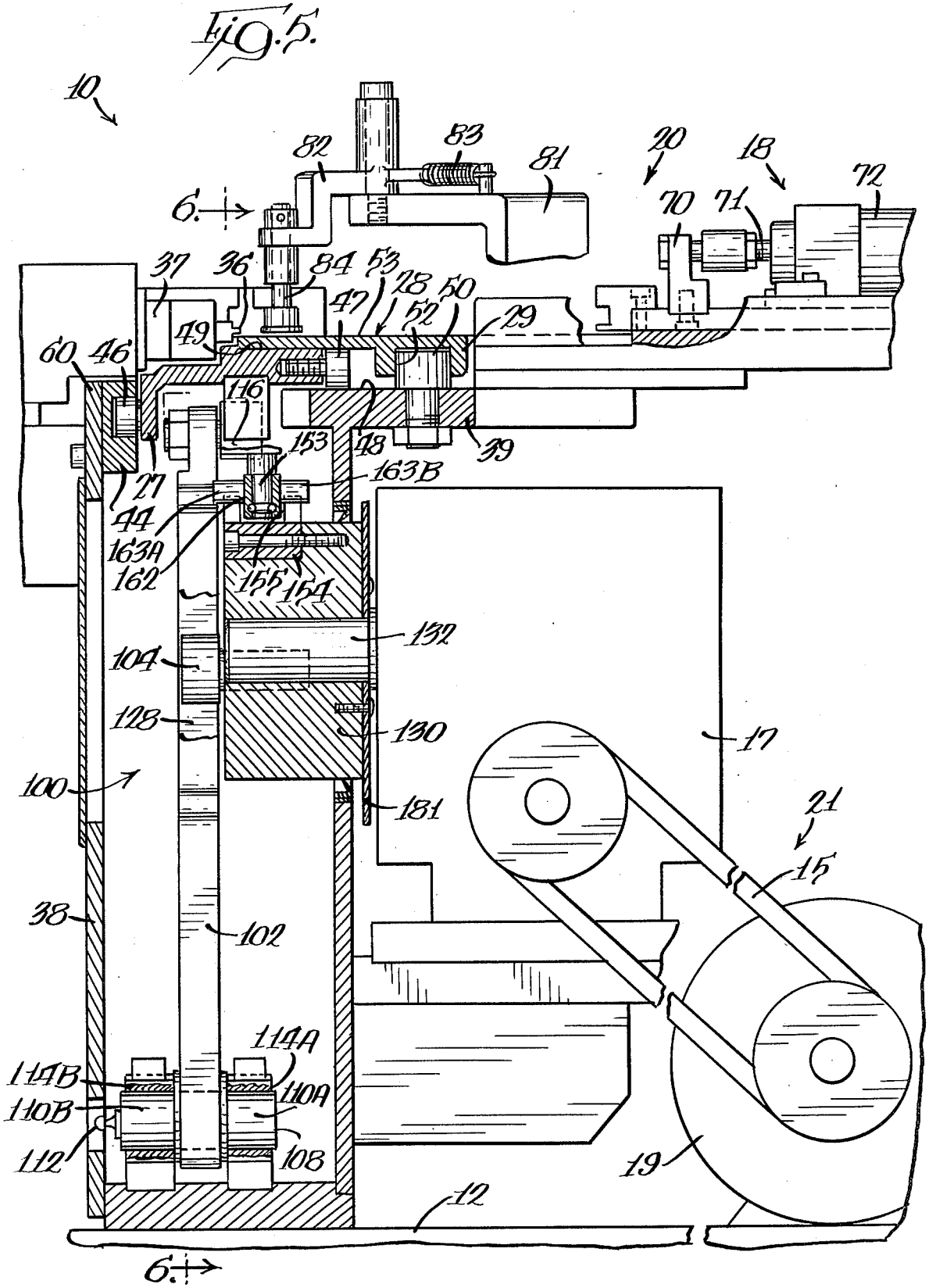
FIG. 5 is a cross-sectional, elevational view of the apparatus shown in FIG. 4 as viewed along line 5—5.

Referring to FIG. 5, the carriage or moving portion 28 of the marking table 20 is guided in movement along a straight line 30 (See FIGS. 2 and 3) by three sets of rollers and two complementary roller channels. The lower carriage 27 is supported by the base 38 by two sets of rollers 46, 47. One set of rollers 46 is constrained to move within a generally rectangular channel defined by a guide member 44 joined to the upper end 60 base 38. The other set of rollers 47 rests atop the upper surface 48 of the fixed portion 39 of the marking table 20.

The upper carriage 29 is joined to and rests atop the upper surface 49 of the lower carriage 27. A generally rectangular channel 52 is formed in the lower side of the upper carriage 29. The corresponding end of the fixed portion 39 of the marking table 20 is provided with a set of rollers 50 complementary to the channel 52 in the upper carriage 29. These rollers 50 are free to rotate about a vertical axis.

Thus, when the upper carriage 29 is joined to the lower carriage 27, the upper surface 53 of the upper carriage 29 is constrained to move along a path determined by the intersection of a generally horizontal plane and a generally vertical plane. The horizontal plane is determined by the path of the two sets of rollers 46, 47 joined to the lower carriage 27 while the vertical plane is determined by the channel 52 provided in the upper carriage 29 and the set of complementary rollers 50 on the fixed portion 39 of the marking table 20.

For purposes of alignment, the guide member 44 (into which one 46 of the two sets of rollers 46, 47 is fitted) is preferably made adjustable relative to the upper end 60 of the base 38. In other words, by adjusting the guide member 44, the upper surface 49 of the lower carriage 27 can be made to travel along a substantially horizontal plane. Similarly, by adjusting the fasteners (not shown) joining the upper carriage 29 to the lower carriage 27, any point on the upper surface 53 of the upper carriage 29 can be made to travel along a substantially horizontal line 30 (See FIGS. 2 and 3). Once this substantially horizontal line segment 30 is determined, any part 40 located on the upper carriage 29 can be positioned so that the mandrel 32 can force that part 40 against the marking die 36 and thereby imprint the part 40 with the characters on the marking die 36. Thus, the rollers 46, 47 on the lower carriage 27 (cooperating with guide member 44 joined to the upper end 60 of the base 38) and the rollers 50 on the upper surface of the fixed portion 39 of the marking table 20 (cooperating with the channel 52 at the lower end of the upper carriage 29) insures that an object or part 40 positioned on the moving portion 28 of the marking table 20 will travel in a substantially horizontal plane.

A number of other components are removably connected to the upper end 60 of the base 38 or the fixed portion 39 of the marking table 20. Referring to FIG. 5, the marking die 36 is fitted within a marking chase 37 movably fastened or joined to the upper end of base 38. The marking die is constructed in accordance with standard practice. Preferably, the marking chase 37 can be readily aligned so as to arrange the characters on the marking die 36 in a substantially horizontal line.

Figure 4:
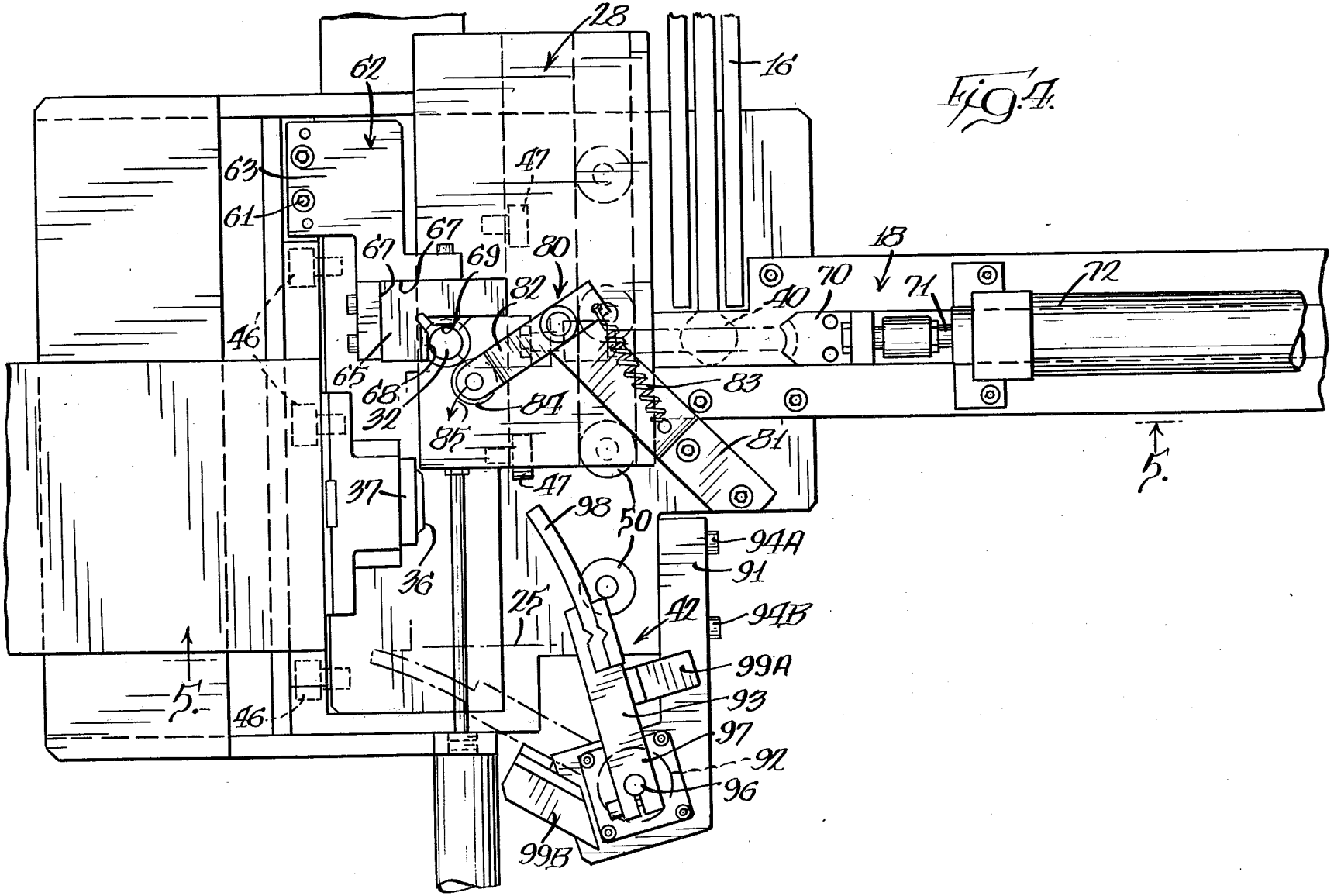
FIG. 4 is a plan view of the apparatus shown in FIG. 1, which includes the marking table shown in FIGS. 2 and 3.

Referring to FIG. 4, at the same side of the upper end 60 of the base 38 as the marking chase 37, a parts locator 62 is positioned. The parts locator 62 is formed from two separate elements—a support element 63 and a guide element 65. The guide element 65 is joined to the support element 63 and the support element 63 is, in turn, joined to the fixed portion 39 of the marking table 20 by removable fasteners 61. The support element 63 defines two generally mutually perpendicular vertical planes or surfaces 66, 67. The guide element 65 is positioned at the intersection of these two surfaces 66, 67 on the support element 63. The guide element 65, in turn, defines two substantially mutually perpendicular vertical planes or jaws 68, 69, into which the part that is to be marked is positioned for coupling to the mandrel 32. By forming the parts locator 62 from two elements, the guide element 65 can be readily changed without extensive alignment. The guide element 65 is shaped to match the configuration of parts that are to be marked (See FIG. 7).

The upper end 60 of the base 38 defining the fixed part 39 of the marking table 20 also supports the chute 16 (supplying parts for marking) and the feeding mechanism 18 used to position unmarked parts into the guide element 65 of the parts locator 62 for coupling to the mandrel 32. In the particular embodiment illustrated in FIG. 4, the feeding mechanism 18 includes an air cylinder 72 to which a parts shuttle 70 has been attached. The parts shuttle 70 is joined to the piston rod 71 of the air cylinder 72. Thus, when the side of the piston (not shown) opposite the connecting rod 71 is pressurized, the connecting rod is forced outwardly from the air cylinder 72 to drive the parts shuttle 70 into engagement with a part 40 (shown in phantom in FIG. 4) supplied from the chute 16. Further expansion of the air within the air cylinder 72 drives the parts shuttle 70 and the associated part into the jaws 68, 69 of the parts locator 62. When the air cylinder 72 is vented (in the case of a single acting air cylinder) or the side of the piston joined to the connecting rod 71 is pressurized (in the case of a double acting air cylinder), the parts shuttle 70 is withdrawn from the moving portion 28 of the marking table 20 thereby clearing the moving portion of the marking table for movement along the marking die 36. Other mechanisms known to those skilled in the art may be used to supply parts serially for marking and for positioning parts onto the marking table for marking.

When an unmarked part is forced onto the moving portion 28 of the marking table 20 by the feeding mechanism 18, there is a short period of time during which the part is held in position only by virtue of the force of the parts shuttle 70 against the jaws 68, 69 of the part locator 62. In order to improve the speed of the marking cycle, it is desirable to withdraw the parts shuttle 70 as soon as possible. The time to withdraw the parts shuttle 70 from the moving portion 28 of the marking table 20 is relatively long considering the relatively short time it takes to couple a part to the mandrel 32. For this reason, the marking machine 10 is provided with a stabilizing assembly 80.

Referring to FIGS. 4 and 5, the stabilizer assembly 80 is formed from three major components: a fixed extension arm 81 joined to the fixed portion 39 of the marking table 20, a rotatable guide arm 82 pivoted to the fixed extension arm, and a spring 83. The spring 83 joins one end of the guide arm 82 with the fixed arm 81. In particular, the spring 83 biases the guide arm 82 so as to hold a part between the jaws 68, 69 of the parts locator 62. A roller pin 84 is positioned at the free end of the guide arm 82. This pin 84 is free to rotate about a vertical axis. As the part is forced onto the carriage 28 by the parts shuttle 70, one end (the forward end of the part) engages the roller pin 84. Because the guide arm 82 is pivoted to the fixed extension arm 81, the roller pin 84 is free to be pushed aside (arrow 85) by the part. However, by virtue of the spring 83, the roller pin 84 is kept in continual contact with the part. Thus, once the parts shuttle 70 is withdrawn from the moving portion 28 of the marking table 20, the roller pin 84 joined to the guide arm 82 continues to hold the part within the grip of the jaws 68, 69 of the part locator 62. Since the two jaws 68, 69 define two mutually perpendicular vertical planes, the part is automatically aligned along a substantially vertical axis coaxial to the axis of the mandrel 32 while the parts shuttle 70 is withdrawn from the carriage 28.

Once the part has been coupled to the mandrel 32, the support provided by the pin 84 on the guide arm 82 is no longer needed. Since the head of the roller pin 84 generally occupies an area corresponding to one of the quadrants of the mandrel 32, the guide arm 82 will be forced out of the path of the part when the moving portion 28 of the marking table transits across the marking die 36. Thus, the stabilizing assembly 80 cycles from its biased position two times during each marking cycle—it moves once when the parts shuttle 70 drives the part into the jaws 68, 69 of the part locator 62, and it moves when the mandrel 32 carries the part across the marking die 36.

The upper end 60 of the base 38 also supports an ejection mechanism 42 used to clear the marked parts from the marking machine 10 at the end of the marking cycle. The ejection mechanism 42 is formed from three major components, a support frame 91, a rotary actuator 92, and a swing arm 93. The support frame 91 is removably joined to the fixed portion 39 of the marking table 20. In the embodiment illustrated in FIG. 4, two threaded fasteners 94A and 94B hold the support frame 91 to the marking table 20. The rotary actuator 92 is removably joined to the free end 95 of the support frame 91 to facilitate maintenance and repair. The armature or shaft portion 96 of the rotary actuator 92 extends out of the upper end of the rotary actuator. The swing arm 93 is joined to the shaft 96. The swing arm 93 is formed from two components: a rigid member 97 joined to the shaft 96, and a flexible member 98 joined to the free end of the fixed member 97. The flexible member 98 is formed from neoprene, or some similar soft, elastomeric or rubber material. It is this end of the ejection mechanism 42 that physically contacts with the marked part and drives the marked part free from the marking machine 10. The support frame 91 also includes two bumpers 99A and 99B. One bumper, 99A positions the free end of the swing arm 93 sufficiently clear from the path of the mandrel 32 so as not to interfere with the marking of the part, yet at the same time sufficiently close to the finish position 25 of the mandrel 32 that there is a minimum of wasted motion before the swing arm 93 makes contact with the marked part and drives it free from the marking table 20. The second bumper 99B is joined to the free end 95 of the support frame 91 to limit the travel of the swing arm 93.

TABLE DRIVING MECHANISM

The mechanism used to reciprocate the moving portion 28 of the marking table 20 will now be described. Referring to FIG. 6, there is illustrated a slotted link and the roller crank assembly or driving mechanism 100 that is used to move the lower carriage 27 and the upper carriage 29. The driving mechanism 100 has the following major components: a slotted arm or link 102; a power roller 104; and a marking table carrier 106.

The arm 102 is keyed at 111 to a pivot pin 109 that is free to rotate about a horizontal axis. The pivot pin 108 is in turn supported by two journals 110A and 110B joined to the bottom of the base 38 (See FIG. 5). Each of the journals 110A and 110B is removably joined to the bottom of the base 38 to facilitate maintenance and adjustment. A grease fitting 112 is provided to lubricate the metal surfaces between the pivot pin 108 and a set of bushings 114A, 114B housed in the journals 110A, 110B. The other end of the arm 102 carries a roller 116 that is free to rotate about a horizontal axis. In the specific embodiment illustrated in FIG. 6, the roller 116 is joined to the arm 102 by a threaded fastener 118.

The marking table carrier 106 (See also FIG. 7) is joined to the moving portion 28 of the marking table 20. Specifically, it is joined to the lower carriage 27. The table carrier 106 is formed from a yoke-like housing or block that defines a generally rectangular channel 122 into which the roller 116 at the free end of the arm 102 is free to rotate. The block 106 is joined to the lower carriage 27 of the moving portion 28 of the marking table 20 by removable fasteners 120A, 120B. Thus, if the arm 102 is forced to swing through an arc about pivot pin 108, the moving portion 28 of the marking table 20 will be driven along the straight line path defined by the support rollers 46, 47 and the guide roller 50 previously described (See FIG. 5). For convenience, an adjustable stop 124 is provided to adjust the stroke of the marking table carrier 106. In the embodiment illustrated in the drawings, the adjustable stop 124 is formed from a threaded stud 125 and nut 126 joined to the upper end 60 of the base 38. The stop 124 adjusts the "insert dwell" of the driving mechanism 100. This will be explained at a later point in this discussion.

The arm 102 is driven or pivoted by the power roller 104 moving within generally rectangular slot 128 at the upper end of the arm 102. Referring to FIGS. 5 and 6, the power roller 104 is eccentrically mounted on a large hub 130 keyed to a drive shaft 132 protruding from the motor and reduction gear assembly 21. Specifically, an electric motor 19 drives a reduction gear box 17 by means of a belt 15. Thus, when the drive shaft 132 is rotated, the power roller 104 rotates in a planetary fashion about the drive shaft 132. The axis of drive shaft 132 and the axis of pivot pin 108 at the lower end of the arm 102 define a generally vertical plane.

A central feature of driving mechanism 100 is the relationship between the width of the slot 128 and the diameter of the power roller 104. Referring to FIG. 6, it should be apparent that by making the slot 128 larger than the diameter of the power roller 104, there will be certain periods of time in the rotational cycle of the hub 130 during which the power roller 104 is free to rotate without inducing motion to the sides of the slot 128. This period of lost motion sets the "dwell" of the driving mechanism 100. It is during this period of time that the moving portion or carriage 28 of the marking table 20 is stationary. This stationary period or interval occurs at either end of the marking stroke or return stroke of the marking table. Thus, there is a certain period of time when the carriage 28 is stationary and in the start position 23 despite the fact that the drive hub 130 undergoes rotation. The period of time during which the carriage 28 is stationary at the beginning of the marking stroke is called "insert dwell" or the insertion dwell period. The period of time at the end of the marking stroke during which the table is stationary is defined as the "eject dwell" or the ejection dwell period. The significance, importance, and use of these stationary periods will be explained at a later point in this discussion.

The particular linkage structure formed by the arm 102 and the power roller 104 and hub 130 is sometimes called a quick-return linkage or quick-return mechanism. With such a linkage, the forward stroke or the first stroke of the reciprocating end of the pivoted arm 102 occurs at a relatively lower speed or velocity than the stroke from the finish position 25 to the start position 23. This variation in speed is brought about because the free end of the arm 102 is driven at a higher angular velocity during the return stroke than during the marking or forward stroke. As the power roller 104 is driven clockwise from the 9 o'clock to the 3 o'clock position, it should be apparent that it is at a greater distance from the fixed end of the arm 102 than during that portion of the cycle from the 3 o'clock to the 9 o'clock position. Thus, the arm 102 travels over a greater arc in moving from the 9 o'clock to the 3 o'clock position over the same period of time than in moving from the 3 o'clock to the 9 o'clock position. Since the power roller 104 rotates at a constant angular velocity relative to the drive shaft 132, the linear velocity at the free end of the arm 102 is higher or greater during the return stroke than the linear velocity during the marking stroke. Since the marking stroke is when useful work is performed on the part and the return stroke is, so to speak "wasted effort," it is desirable to return the moving portion 28 of the marking table 20 to the start position 23 as soon as possible after the part has been ejected from the marking table 20. Thus, the use of a quick-return linkage to impart reciprocating motion to the moving portion 28 of the marking table 20 is especially appropriate for this machine application. It combines the speed of a planetary marking machine with the basic simplicity of a reciprocating machine.

Because the moving portion 28 of the marking table 20 is essentially unrestrained by the power roller 104 during the insert dwell period, it is desirable to insure that the moving portion 28 of the marking table 20 is held in the start position 23 while a part is coupled to the mandrel 32. For this purpose, a pneumatic brake 140 is provided.

Referring to FIG. 6, the pneumatic brake 140 in the embodiment illustrated, is a single-acting air cylinder 141. A connecting rod 142 joins the piston 143 within the air cylinder 141 and the moving portion 28 of the marking table 20. The air cylinder 141 is pressurized to drive the piston 143 and the connecting rod 142 in the direction of two carriages 27, 29. As long as pressure is applied to the piston 143, the moving portion 28 of the marking table 20 will be held in a fixed position. As soon as the air is vented from the air cylinder 141, the moving portion 28 of the marking table 20 is free to move under the force of the driving mechanism 100. The mandrel 32 is joined to the unmarked part 40 during the insertion dwell period. It is during this period of time that the air cylinder 141 is pressurized to hold the moving portion 28 of the marking table 20 in position. At the end of the insertion dwell period, the power roller 104 comes into contact again with the slot 128 on the arm 102. Since the moving portion 28 of the marking table 20 is now under the control of the power roller 104, the air in the air cylinder 141 can be vented and the pneumatic brake 140 is released.

In the embodiment illustrated, air is directed into the air cylinder 141 in response to the operation of a limit switch 144 that is activated by one end 145 of the moving portion 28 of the marking table 20. Thus, when the power roller 104 returns the moving portion 28 of the marking table 20 to the start position 23, this limit switch 144 is actuated. The limit switch 144 operates a solenoid actuated air valve. When the valve (not shown) is opened air is forced into the air cylinder 141 which in turn pressurizes the piston 143 and forces or holds the moving portion 28 of the marking table 20 in the start position 23. Once the moving portion 28 of the marking table 20 is driven from the start position 28 (i.e., the end of insertion dwell period), the limit switch 144 shifts position which in turn vents the air cylinder 141.

The limit switch 144 is conventional. Such switches typically employ a moving arm 139 that activates a plurality of electrical contacts (not shown) on the inside of the limit switch. The free end of the arm 139 is ordinarily joined to a roller 146 to facilitate engagement with a moving object (here table edge 145). As will become apparent at a later point in this discussion, such a limit switch 144, that is, one with a roller 146 at the free end of the arm 139, is particularly useful in those applications where a cam is used to trip the limit switch 144. In those applications, the arm 139 and the roller 146 act as a "follower" relative to the cam. It should be noted that it is desirable to use limit switches wherever they are needed which are otherwise identical in construction. Maintenance, repair, and procurement of spare parts is facilitated by such commonality.

MANDREL

Figures 7, 8:
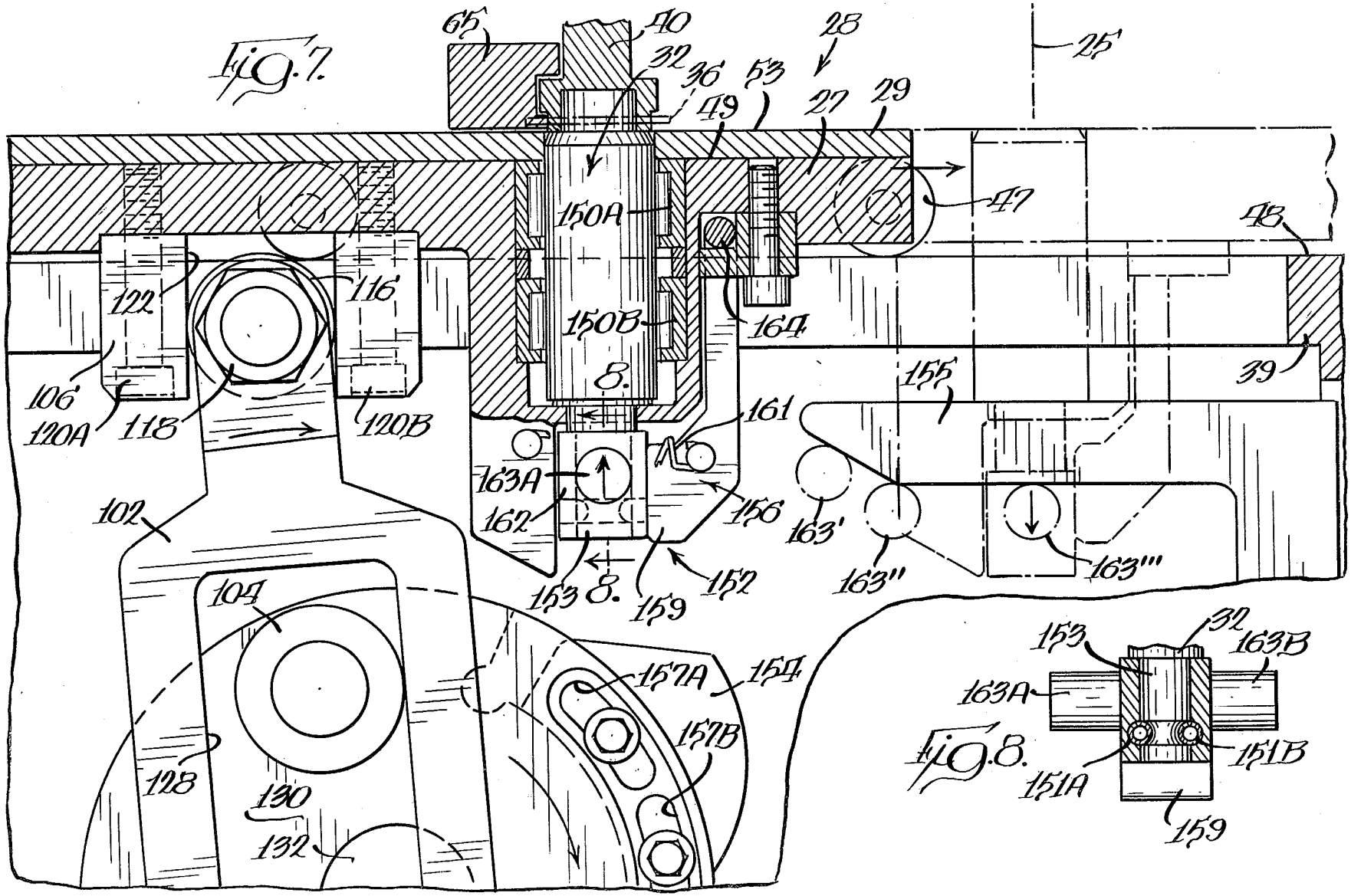
FIG. 7 is a partial, cross-sectional, elevational view of an enlarged portion of the marking machine shown in FIG. 6.
FIG. 8 is an enlarged view of the follower assembly shown in FIG. 5.

The only major component of the marking machine 10 which has not been heretofore discussed in detail is the mandrel 32. Referring to FIGS. 6 and 7, the mandrel 32 is housed within the moving portion 28 of the marking table 20. Specifically, the mandrel 32 is a substantially cylindrically shaped spindle that is journaled within two roller bearings 150A, 150B joined to the lower carriage 27. An opening in the upper carriage 29 allows the mandrel 32 to couple with the part to be marked. The mandrel supports the part 40 during marking.

The lower end of the mandrel 32 is joined to a follower assembly 152. The follower assembly 152 is positioned by a cam 154 joined to the hub 130 and a cam 155 joined to the upper end 60 of the base 38. The cam 154 on the hub 130 raises the mandrel 32 to accept or couple to the part to be marked. The cam 155 joined to the base 38 lowers the mandrel 32 at the end of the marking cycle or when the mandrel 32 is in the finish position 25. A drag assembly 156 carried by the lower carriage 27 holds the mandrel 32 in the raised position until the follower assembly 152 comes in contact with the lowering cam 155. Specific in details of these components will now be discussed.

FIG. 6 shows the follower assembly 152 in the lowered position. FIGS. 5 and 7 show the follower assembly 152 in the raised position. Referring to FIG. 7, the follower assembly 152 is joined to the lower end 153 of the mandrel 32 by a pair of roll pins 151A, 151B (See FIG. 8). This arrangement facilitates removal transferability or interchangeability of mandrels having different shapes or shapes keyed to parts of different configurations. In addition the roll pins allow the mandrel to rotate about a vertical axis while allowing the mandrel to be reciprocated between a raised and a lowered position.

The follower assembly 152 (See FIG. 7) is formed from a coupling 162 (which slides over the lower end 153 of the mandrel 32) and two cylindrical followers 163A, 163B (to each side of the coupling 162). The axis of each of the followers 163A, 163B is perpendicular to the axis of the coupling 162. Thus, by raising and lowering the two followers 163A, 163B, the mandrel 32 is raised and lowered.

The raising cam 154 is joined to the periphery of the hub 130. This cam 154 raises the two followers 163A, 163B and the coupled mandrel 32. The raising cam 154 is a bifurcated structure (see FIG. 5) in that it defines a channel 155 of a generally rectangular cross-section to facilitate the passage of the coupling 162 supporting the two followers 163A, 163B. The raising cam 154 is removably joined to the hub 130 by removable fasteners fitting within a pair of slots 157A, 157B to facilitate adjustment and positioning of the raising cam on the hub 130.

Once the mandrel 32 has been raised by the raising cam 154, it is held in the raised position by the drag assembly 156. The upper end 164 of the drag assembly 156 is pivotally connected to and supported by the lower carriage 27. The drag assembly 156 includes a spring 161 tending to force or bias the lower end 159 of the drag assembly against the coupling portion 162 of the follower assembly 152. Thus, when the follower assembly 152 is raised to the position shown in FIGS. 5 or 7, the bias spring 161 forces the lower end 159 of the drag assembly 156 against the follower assembly 152 to hold the mandrel 32 in the raised position.

Once the mandrel 32 has been lifted to the raised position, it is forced to the lower position (See phantom on FIG. 7) by the lowering cam 155. The lowering cam 155 is so positioned in relation to the follower assembly 152 that the two followers 163A and 163B are forced into engagement with the lowering cam 155 when the mandrel 32 has been driven to the finish position 25. The force of the lowering can 155 coacting with the followers 163A, 163B overcomes the drag spring 161 to move the mandrel 32 downwardly. When the mandrel 32 is lowered it is decoupled from the marked part. FIGS. 6 and 7 illustrate (by a series of circles 163', 163'', 163''' shown in phantom) the position of the followers 163A, 163B as carriage 28 is moved from the start position 23 to the finish position 25.

Two components remain to be described. The first of these is a limit switch 170 (see FIG. 6) mounted at the lower end of the base 38. This limit switch 170 is actuated when the arm 102 is driven to the end of the marking stroke, that is, when the mandrel 32 has been moved to the finish position 25. The limit switch 170 when actuated by the arm 102 is used to operate the ejection mechanism 42 previously described. Thus, after the part has been marked and when the moving portion 28 of the marking table 20 is at the finish position and the mandrel 32 has been lowered, this limit switch 170 is tripped to activate the rotary actuator 92 that forces the marked part from the marking table 20.

The last part remaining to be described is also a limit switch. This limit switch 180 is also joined to a fixed portion of the base 38. A circular cam 181 is joined to the hub 130. The roller 182 joined to an arm 183 that activates the limit switch 180 in response to the rotation of the cam 181. This limit switch 180 actuates the feeding mechanism 18 previously described.

As shown in FIG. 6, cam 181 has two major lobes. The upper lobe 181H trips the limit switch 180 which retracts the feeding mechanism 18 from the marking table 20 while the lower lobe 181L advances the feeding mechanism 18 onto the marking table. As can be seen from the figures, with the mandrel 32 in the start position (see FIG. 6) and the power roller 104 about to enter the insert dwell period. The roller 182 on the limit switch 180 rests on the lower lobe 181L when the feeding mechanism 18 has been actuated to position a part in the vicinity of the mandrel 32. Once the power roller 104 has rotated through the insert dwell period (e.g., when it comes into contact again with the slot 128 in arm 102) the roller 182 connected to the limit switch 180 is at the end of the path traversed along the lower lobe 181L. Any further rotation of the hub 130 and cam 181 will raise the roller 182 from the lower lobe 181L to the upper lobe 181H and trip the limit switch 180 which results in the parts shuttle 70 retracting or withdrawing from the marking table 20.

The parts shuttle 70 remains retracted until the end of the marking cycle, at which time the roller 182 is raised and the limit switch 180 is activated to actuate the feed mechanism 18. It should, of course, be appreciated by one skilled in the art that the stroking time of the feed mechanism 18 positioning the parts shuttle 70 on the marking table 20 has to be sufficiently fast in order for the part to be positioned over the mandrel 32 no earlier than the beginning of the insertion dwell period and no later than the end of the insertion dwell period if positive coupling between the part and the mandrel 32 is to occur.

OPERATION

Now that all the major components and subassemblies have been described in detail, the integrated operation of the marking machine 10 will now be described. Referring to FIGS. 2 and 6, the marking machine 10 is shown in the start position 23 at the beginning of the insert dwell period. Immediately prior to this time, the limit switch 180 activating the feed mechanism 18 was tripped so as to actuate the air cylinder 72 to reposition the parts shuttle 70 to move on unmarked part 40 onto the marking table 20. As the parts shuttle 70 is driven towards the mandrel 32, the guide arm 82 on the stabilizer assembly 80 is forced out of the way by the part engaging the roller pin 84. However, once the part has been located on the marking table and before the mandrel 32 couples to the part, the roller pin 84 holds the part against the two jaws 68, 69 of the parts locator 62. Thus, the parts shuttle 70 can be safely withdrawn from the moving portion 28 of the marking table 20. In addition, another limit switch 144 has been tripped so as to activate the air cylinder 141 to hold the two carriages 27, 29 on the marking table 20 in a fixed position during the injection dwell period. In effect a brake has been applied to the moving portion 28 of the marking table 20.

Now, as the hub 130 continues to rotate through the insert dwell period, the raising cam 154 engages the followers 163A, 163B joined to the mandrel coupling 162. This, in turn, raises the mandrel 32 to accept the part 40 held in position by guide arm 82. Soon thereafter, the upper lobe 181H repositions the roller 182 joined to the limit switch 180 activating the feeding mechanism 18. When this happens, the air cylinder 72 withdraws the parts shuttle 70 from the moving portion 28 of the marking table 20.

Now that the feeding mechanism 18 has cleared the marking table 20, and now that the power roller 104 has re-engaged the slotted arm 102, the mandrel 32 will be driven through the marking cycle. Immediately after the arm 102 begins moving the mandrel 32 from the start position, the roller 146 joined to the limit switch 144 actuating the pneumatic brake 140 is released. Once the part 40 is driven from the start position 23, the guide arm 82 on the stabilizer assembly 80 is forced out of the way. With all restraints removed, the moving portion 28 of the marking table 20 is free to re-position from the start position 23 to the finish position 25. It will be re-called that the relative speed of the moving portion 28 of the marking table 20 from the start position 23 to the finish position 25 is slower than its speed from the finish position to the start position 23. As the two carriages 27, 29 are moved in the direction of the marking die 36, an external portion of the part 40 held by the mandrel 32 comes into contact with the characters on the marking die 36. Since the mandrel 32 is free to rotate about a vertical axis, the characters on the marking die 36 will be added serially to the part.

As the moving portion 28 of the marking table 20 approaches the finish position 25, the two followers 163A, 163B come into engagement with the lowering cam 155. Almost simultaneous with the lowering of the mandrel 32, the limit switch 170 actuating the ejection mechanism 42 is tripped. Thus, as the mandrel 32 lowers, the swing arm 93 is driven across the moving portion 28 of the marking table 20 to eject the marked part from the machine 10. The moving portion 28 of the marking table 20 is then forced by the power roller 104 and the arm 102 through the quick-return portion of the cycle. Simultaneously with this action, the limit switch 180 activating feed mechanism 18 is tripped by the lobed cam 181. This occurs when the roller 182 is repositioned from the upper lobe 181H to the lower lobe 181L. Thus, almost simultaneously with the arrival the mandrel 32 at the start position 23, the air cylinder 72 has to be actuated to move the parts shuttle 70 and a new part 41 has been moved onto the marking table 20 (See FIG. 2).

Thus, it is apparent that there has been provided a marking machine 10 that is fast, accurate, easy to maintain and relatively simple in construction compared to machines heretofore known by the art. In addition it is easy to modify and align to accept different parts for marking. While the invention has been described in conjunction with a specific embodiment, it is evident that many alternatives, modifications, and variations will be apparent to those skilled in the art. In light of the foregoing description. Accordingly, it is intended to cover all such alternatives, modifications, and variations as set forth within the spirit and broad scope of the appended claims.

What is claimed is as follows:

1. Apparatus for marking parts, supplied serially thereto, comprising:

(a) a frame;

(b) a platform;

(c) supporting means for slidably supporting said platform on said frame whereby said platform is free to move reciprocatingly in a plane between a first position and a second position;

(d) means, carried by said frame in a fixed position relative to said platform, for imprinting one or more characters on a part;

(e) driving means, carried by said frame, for driving said platform reciprocatingly and continuously in a cycle between said first and said second positions including a slotted link pivotally joined at one end to said frame and coupled at the other end to said platform, a roller crank, the roller end of said crank rotatably fitting within the slot in said link, and rotating means, carried by said frame, for rotating said roller crank at a generally uniform angular velocity, whereby said platform reciprocates between said first position and said second position in a continuous cycle, the relative speed of said platform from said first position to said second position being slower than the relative speed of said platform from said second position to said first position; and (f) means carried by said platform and operatively associated with said driving means for rotatably coupling said part to said platform, for holding said coupled part pressed against said imprinting means while said platform is driven from said first position to said second position whereby the characters on said imprinting means are serially impressed on said part as said part is rotatably drawn across said imprinting means, and for decoupling the marked part after it has been marked before said platform is moved by said driving means from said second position to said first position to receive another part.

2. The apparatus as set forth in claim 1, wherein the diameter of the roller carried by said roller crank is generally less than the width of the slot in said link whereby said link and said platform are stationary during a portion of the rotational cycle of said roller crank.

3. The apparatus as set forth in claim 2, further including holding means, carried by said frame, for holding said platform in said first position while said platform is stationary.

4. The apparatus as set forth in claim 3, wherein said holding means is an air piston and cylinder actuator joined at one end to said platform and at the other end to said frame, said air actuator being pressurized to hold said platform in said first position and being vented to release said platform from said first position.

5. The apparatus as set forth in claim 1, further including: a cam rotated by said rotating means in synchronism with said roller crank; and a limit switch having a trip arm riding against said cam, the rotation of said cam and the tripping of said arm opening and closing said limit switch, whereby the tripping of said limit switch is synchronized with the movement of said platform.

6. Apparatus for marking parts, supplied serially thereto, comprising:

(a) a frame;

(b) a platform;

(c) supporting means for slidably supporting said platform on said frame whereby said platform is free to move reciprocatingly in a plane between a first position and a second position;

(d) means, carried by said frame in a fixed position relative to said platform, for imprinting one or more characters on a part;

(e) driving means, carried by said frame, for driving said platform reciprocatingly and continuously in a cycle between said first and said second positions; and (f) means carried by said platform and operatively associated with said driving means for rotatably coupling said part to said platform, for holding said coupled part pressed against said imprinting means while said platform is driven from said first position to said second position whereby the characters on said imprinting means are serially impressed on said part as said part is rotatably drawn across said imprinting means, and for decoupling the marked part after it has been marked before said platform is moved by said driving means from said second position to said first position to receive another part, said means for coupling and uncoupling including a roller bearing having its race carried by said platform; a mandrel journalled with the rollers of said bearing, and free to move parallel to the axis of said rollers between raised and lowered positions with said mandrel having one end configured to couple with said part, follower means, carried by the other end of said mandrel, for moving said mandrel between said raised and said lowered positions, said mandrel rising to couple said part to said platform and lowering to decouple said part from said platform, first cam means, joined to said driving means and cooperating with said follower means, for raising said mandrel with said platform in said first position, and second cam means, joined to said frame and cooperating with said follower means, for lowering said mandrel with said platform in said second position.

7. The apparatus as set forth in claim 6, further including: drag means, carried by said platform, for frictionally holding said follower means in said raised position after said first cam means has raised said mandrel to said raised position, said second cam means cooperating with said follower means in overcomming said drag means to lower said mandrel to said lowered position.

8. Apparatus for marking parts, supplied serially thereto, comprising:

(a) a frame;

(b) a platform;

(c) supporting means for slidably supporting said platform on said frame whereby said platform is free to move reciprocatingly in a plane between a first position and a second position;

(d) means, carried by said frame in a fixed position relative to said platform, for imprinting one or more characters on a part;

(e) driving means, carried by said frame, for driving said platform reciprocatingly and continuously in a cycle between said first and said second positions;

(f) means carried by said platform and operatively associated with said driving means for rotatably coupling said part to said platform, for holding said coupled part pressed against said imprinting means while said platform is driven from said first position to said second position whereby the characters on said imprinting means are serially impressed on said part as said part is rotatably drawn across said imprinting means, and for decoupling the marked part after it has been marked before said platform is moved by said driving means from said second position to said first position to receive another part;

(g) a cam rotated by said driving means;

(h) switching means, carried by said frame and tripped by said cam, for opening and closing a plurality of electrical contacts whereby said contacts are opened and closed in response to the angular displacement of said cam; and (i) inserting means, actuated by the tripping of said switching means and carried by said frame, for inserting a part onto said platform in a position to be coupled with said platform, said contacts completing an electrical circuit to actuate said inserting means in response to the rotation of said cam by said driving means.

9. The apparatus as set forth in claim 8, wherein said inserting means includes: an air piston and cylinder actuator carried by said frame; and a reciprocating element carried by said actuator and free to stroke between inserted and withdrawn positions, unmarked parts being supplied serially into said element when said element is in the withdrawn position whereby the pressurization of said actuator drives said element and an unmarked part onto said platform and the venting of said actuator withdraws said element from said platform with the unmarked part coupled to said platform.

10. Apparatus for marking parts, supplied serially thereto, comprising:

(a) a frame;

(b) a platform;

(c) supporting means for slidably supporting said platform on said frame whereby said platform is free to move reciprocatingly in a plane between a first position and a second position;

(d) means, carried by said frame in a fixed position relative to said platform, for imprinting one or more characters on a part;

(e) driving means, carried by said frame, for driving said platform reciprocatingly and continuously in a cycle between said first and said second positions;

(f) means carried by said platform and operatively associated with said driving means for rotatably coupling said part to said platform, for holding said coupled part pressed against said imprinting means while said platform is driven from said first position to said second position whereby the characters on said imprinting means are serially impressed on said part as said part is rotatably drawn across said imprinting means, and for decoupling the marked part after it has been marked before said platform is moved by said driving means from said second position to said first position to receive another part;

(g) ejecting means, joined to said frame for ejecting a marked part from said platform after said platform has been moved to said second position; and (h) electrical switch means carried by said frame and tripped by said driving means, for actuating said ejecting means, whereby said ejecting means operates in response to the position of said platform.

11. Apparatus for marking parts, comprising: a frame; a carriage slidably mounted on one end of said frame and free to move reciprocatively between first and second positions; means carried by said frame in a fixed position relative to said platform, for imprinting a character on the exterior surface of a part; means, carried by said frame, for driving said table reciprocatingly in a continuous cycle between said first and said second positions; said driving means including a slotted link pivotally joined at one end to said frame and coupled at the other end to said platform, the slot in said link lying between the two ends of said link, that end of said slot closest to said one end defining the inner end of said slot; a roller crank having its roller and fitting within said slot and means, carried by said frame for rotating said roller crank at a generally uniform angular velocity whereby said platform is forced to oscillate between said first and second positions, the roller portion of said crank fitting within and pointing in the direction of said inner end of said slot during that portion of the cycle of said platform between said first position and said second position such that the relative speed of said platform from the first to the second position is slower than the relative speed of said platform from the second to the first position; feeding means, disposed on said frame, for feeding parts serially onto said platform with said platform in first position; and means carried by said platform for rotatably coupling the part supplied by said feeding means to said platform, for holding a portion of the exterior surface of said part pressed against said imprinting means while said platform is driven from the first position to the second position whereby the character on said imprinting means is impressed on said part, and for decoupling said part after said platform has been driven to said second position, said platform returning to said first position after marking said part whereupon said feeding means feeds another part onto said platform.

12. The apparatus as set forth in claim 11, wherein the width of said slot is greater than the diameter of said roller whereby said platform is stationary at the first and second positions at least for a fraction of the period of said roller crank.

13. The apparatus as set forth in claim 12, further including: means, anchored to said frame, for holding said platform in said first position while said coupling means is mated to said part.

* * * * *